US006243912B1

(12) United States Patent
Grey

(10) Patent No.: US 6,243,912 B1
(45) Date of Patent: Jun. 12, 2001

(54) APPARATUS FOR CLEANING FLOORS, CARPETS AND THE LIKE

(75) Inventor: Nicholas Gerald Grey, Worcester (GB)

(73) Assignee: Vax Limited, Worcester (GB)

( * ) Notice: Subject to any disclaimer, the term of this patent is extended or adjusted under 35 U.S.C. 154(b) by 0 days.

(21) Appl. No.: 09/125,662

(22) PCT Filed: Feb. 13, 1997

(86) PCT No.: PCT/GB97/00402

§ 371 Date: Aug. 24, 1998

§ 102(e) Date: Aug. 24, 1998

(87) PCT Pub. No.: WO97/30622

PCT Pub. Date: Aug. 28, 1997

(51) Int. Cl.[7] ..... A47L 7/00

(52) U.S. Cl. ..... 15/320; 15/328; 15/350; 15/353

(58) Field of Search ..... 15/320, 321, 353, 15/328, 350, 351

(56) References Cited

U.S. PATENT DOCUMENTS

| | | | | |
|---|---|---|---|---|
| 2,639,005 | * | 5/1953 | Gerstmann | 15/353 X |
| 2,955,674 | * | 10/1960 | Krammes | 15/320 X |
| 3,029,461 | * | 4/1962 | Osborn | 15/328 X |
| 3,055,039 | * | 9/1962 | Smith | 15/320 X |
| 3,079,626 | | 3/1963 | Yonkers et al. | 15/320 |
| 3,180,071 | * | 4/1965 | Nolte | 15/328 X |
| 3,343,199 | * | 9/1967 | Nolte | 15/328 X |
| 4,167,800 | | 9/1979 | Tribolet . | |
| 4,216,563 | * | 8/1980 | Cyphert | 15/328 X |
| 4,287,635 | | 9/1981 | Jacobs . | |
| 4,367,565 | * | 1/1983 | Parise | 15/328 X |
| 4,665,582 | * | 5/1987 | Richmond et al. | 15/351 X |
| 5,608,945 | * | 3/1997 | Crouser et al. | 15/328 |
| 5,715,566 | * | 2/1998 | Weaver et al. | 15/328 X |
| 5,735,017 | * | 4/1998 | Barnes et al. | 15/328 X |
| 5,935,279 | * | 8/1999 | Kilstrom | 15/350 X |

FOREIGN PATENT DOCUMENTS

| | | |
|---|---|---|
| 1703220 | 3/1972 | (DE) . |
| 2 038 168 | 7/1980 | (GB) . |
| 1601456 | 10/1981 | (GB) . |
| 2019121 | 9/1994 | (RU) . |
| 370939 | 11/1973 | (SU) . |
| 1694105 | 11/1991 | (SU) . |
| 94/17723 | 8/1994 | (WO) . |
| 94/17722 * | 8/1994 | (WO) . |

* cited by examiner

*Primary Examiner*—Chris K. Moore
(74) *Attorney, Agent, or Firm*—Venable; George H. Spencer; Robert Kinberg

(57) ABSTRACT

A collection container (40) for matter picked up by a suction cleaner comprises a generally cylindrical body (45) into which an inlet tube (46) extends upwardly from the base (43) thereof. To enable the collection container to be adapted for the collection of either liquids or solids entrained in air flow induced through the inlet tube (46), two interchangeable separator units (60, 70) are provided. Separator unit (60), for use in the wet mode, comprises a tube (61) which forms an extension of the suction tube (46), with a baffle wall (64) over the open mouth thereof, and additionally an oblique annular baffle plate (66) may be provided in the vicinity of the junction between the two tubes (46, 61). The separator unit (70), for use in the dry mode, comprises a mounting ring (72) carrying a tubular filter element (71), the lower end of which is closed by a baffle plate (73) which registers with the open end of the inlet tube (46) in spaced relation thereto.

15 Claims, 2 Drawing Sheets

APPARATUS FOR CLEANING FLOORS, CARPETS AND THE LIKE

BACKGROUND OF THE INVENTION

This invention relates to apparatus for cleaning floors, carpets and the like and is more particularly concerned with a dual purpose apparatus suitable for both dry suction cleaning ("vacuum" cleaning) and for wet process cleaning operations involving the application and removal of a liquid. Such apparatus is sometimes known as a "three-in-one" appliance since, in addition to performing normal dry vacuuming operations and wet cleaning operations, it can also be used simply for drying floors or picking up spillages.

Many designs have been proposed for such dual purpose appliances, but the concept of interchangeability between wet and dry modes of operation has successfully been applied only in the context of vacuum cleaners of the so-called "canister" type in which a cleaning implement to which suction is applied is connected to a source of suction within a body of the appliance by means of a flexible hose. In general, the body of appliances of the canister type can be made relatively large and, indeed, heavy because, whilst it is mobile (on castors or the like) it is not required to be moved constantly back and forth by the user.

However, an alternative form of vacuum cleaner which is in common use is the so-called "upright" type in which a main cleaning implement is carried by a body of the appliance together with a source of suction so that the appliance as a whole is normally required to be moved back and forth by the user. Thus, different constraints on size and weight apply in the case of vacuum cleaners of the upright type, and for this reason it has not previously been possible to provide a commercially successful cleaner of the upright type which is capable of operating in both wet and dry modes.

In our British Patent specifications 1601456 and 2038168 there are disclosed two vacuum cleaners of the canister type in which a reservoir assembly for a cleaning liquid and a filter assembly for the separation of dry dust are interchangeably assembled between a source of suction and a collection container which is thereby adapted for either wet or dry operation. Thus the main body of the appliance in either mode of operation comprises three sections which are releasably clipped together, the central section comprising either of the two interchangeable sections. Such an arrangement is generally satisfactory for vacuum cleaners of the canister type because they stand stably on the floor and the user can use two hands to manipulate the various components as necessary without undue difficulty.

Whilst, theoretically, such a three-section construction could be adopted for a vacuum cleaner of the upright type, in practice this has a number of disadvantages to the user in particular.

Even where the upright cleaner is of the kind which includes a base member, in which the main cleaning implement and motor/impeller unit are located, with a swivellably connected handle portion carrying the collection container, so that the appliance as a whole can stand stably on the floor with the handle assembly in an upright position, the appliance is generally less stable than a cleaner of the canister type, partly because of its greater height and partly because of the swivellable connection between the handle assembly and the base member, so that manipulation of interchangeable sections to convert from wet to dry mode may be difficult. The difficulties would be even greater with a vacuum cleaner of the so-called "stick" type in which the cleaning implement is not incorporated in a base member whereby the appliance as a whole can stand in a stable manner on the floor.

Our International Patent specifications WO94/17722 and WO94/17723 disclose an appliance of the stick type in which the collection container is removably housed within a recess formed in a body of the appliance, but without any provision for conversion between wet and dry modes of operation, the collection container being removably coupled at its upper end to an air/liquid separator disposed non-removably within the body of the appliance.

OBJECTS AND SUMMARY OF THE INVENTION

Accordingly, it is an object of the present invention to provide a vacuum cleaner generally of the upright type (which term includes the stick type) which is adapted for operation selectively in wet and dry modes.

According to the present invention we provide a vacuum cleaner of the kind comprising a main cleaning implement which is carried by a body of the appliance together with a source of suction, the body having a recess adapted to receive a collection container releasably through an opening formed at one side of the body, wherein said collection container includes a suction passage which is releasably connectable at the base of the container to a suction duct connected with said cleaning implement, connection means are provided at the upper end of the collection container for releasable connection to a source of suction within the body to establish suction at said cleaning implement and air flow from said implement through said duct and said passage to said source of suction, and two interchangeable separator units are provided for selective assembly with the collection container, one of said separator units being a wet-mode separator unit which is adapted for connection to said suction passage when the apparatus is to be operated in a wet mode and operates to separate entrained liquid droplets from the air-flow, and the other of said separator units being a dry-mode separator unit which is adapted to be mounted within the collection container at a position spaced from said passage when the apparatus is to be used in the dry mode and operates to separate dry material entrained in the air-flow.

The wet mode separator unit may comprise a tube, forming in use an extension of said suction passage in the collection container, and having an outlet opening in register with a transversely disposed baffle which serves to reverse the direction of air flow and function as an air/liquid separator within the collection container. Preferably the suction passage is disposed centrally within said collection container, the tube also being disposed centrally of the collection chamber.

The baffle is preferably formed with a generally cylindrical skirt which extends over, and in spaced relation to, an end portion of said tube, said skirt being spaced inwardly from the side wall of the collection container.

Desirably, the wet mode separator unit also includes an obliquely inclined annular baffle plate which is arranged to extend across the collection container. The annular baffle plate may be carried by an oblique end face at the lower end of a tubular wall which is removably located within said collection container.

The dry mode separator unit may comprise a filter element adapted to be disposed within the collection container between the outlet of said suction passage and said connection means at the upper end of the collection chamber.

The filter element may be carried by a mounting ring which is removably mounted within, and sealingly engages against, the side wall of said collection container, and is preferably of tubular form and at the end thereof remote from said mounting ring is closed by a baffle plate which, in use, is in register with and spaced from the outlet of said suction passage in said collection container.

The invention further resides in a collection container for use with a vacuum cleaner of the kind comprising a main cleaning implement which is carried by a body of the appliance together with a source of suction, the body having a recess adapted to receive the collection container releasably through an opening formed at one side of the body, wherein the collection container comprises a suction passage which is releasably connectable at the base of the container to a suction duct in the cleaner, itself connected with said cleaning implement, connection means at the upper end of the collection container for releasable connection to said source of suction within the body of the cleaner to establish suction at said cleaning implement and airflow from said implement through said duct and said suction passage to said source of suction, and a separator unit connected to said suction passage and adapted to function as an air/liquid separator operating to separate entrained liquid droplets from the air flow to enable the cleaner to be operated in a wet mode.

The invention also resides in a vacuum cleaner having such a collection container releasably assembled therewith.

The invention further resides in a collection container for use with a vacuum cleaner of the kind comprising a main cleaning implement which is carried by a body of the appliance together with a source of suction, the body having a recess adapted to receive the collection container releasably through an opening formed at one side of the body, wherein the collection container comprises a suction passage which is releasably connectable at the base of the container to a suction duct in the cleaner, itself connected with said cleaning implement, connection means at the upper end of the collection container for releasable connection to said source of suction within the body of the cleaner to establish suction at said cleaning implement and airflow from said implement through said duct and said suction passage to said source of suction, and a separator unit mounted within the collection container at a position spaced from said suction passage and adapted to function as a solid matter separator to enable the cleaner to be used in a dry mode, operating to separate solid material entrained in the airflow.

The invention further resides in a vacuum cleaner having such a collection container assembled therewith.

BRIEF DESCRIPTION OF THE DRAWINGS

These and other features of the invention will now be described by way of example with reference to the accompanying drawings wherein.

DETAILED DESCRIPTION OF THE INVENTION

Figure 1:
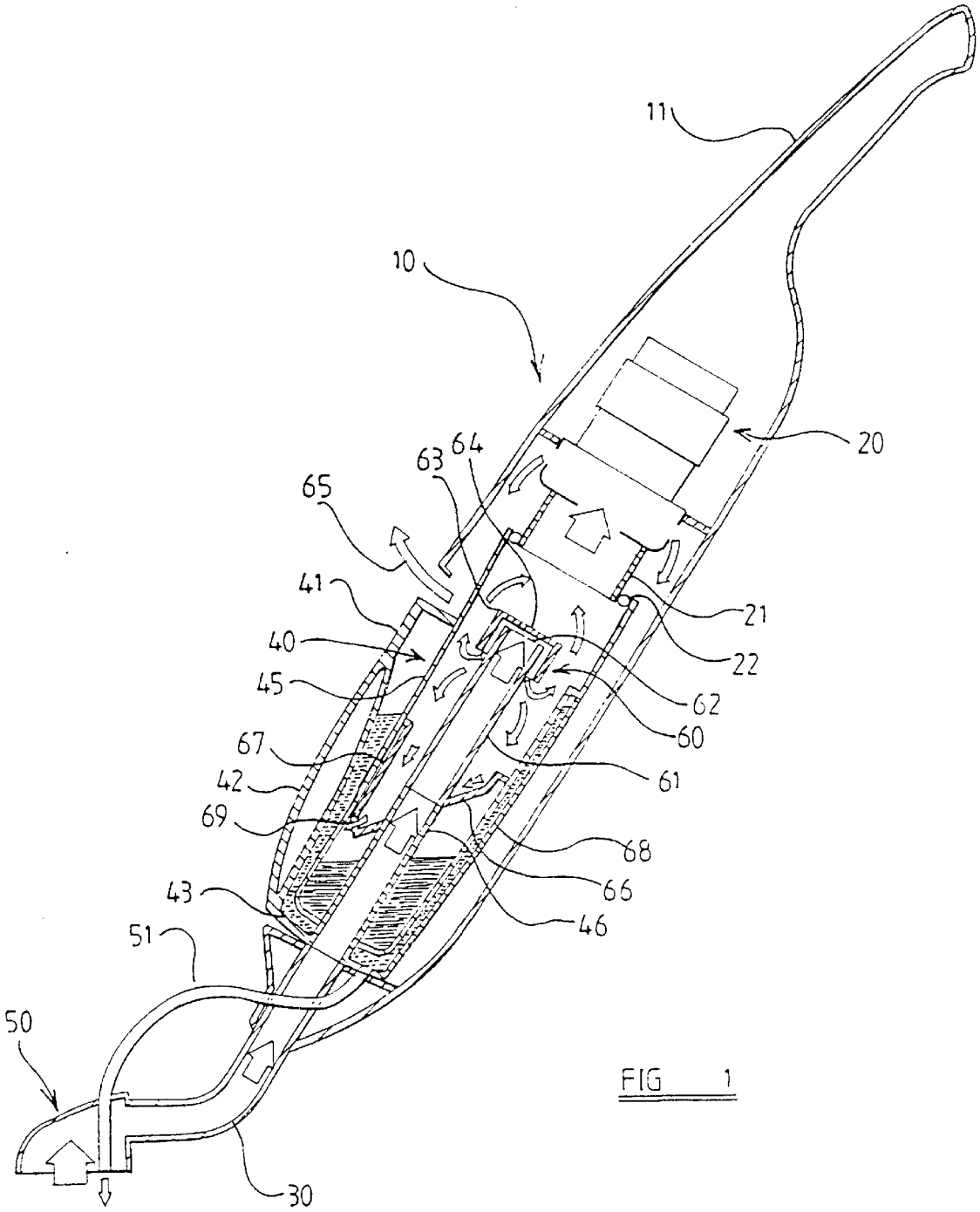
FIG. 1 shows one embodiment of vacuum cleaner in accordance with the invention set up in the wet mode.
Figure 2:
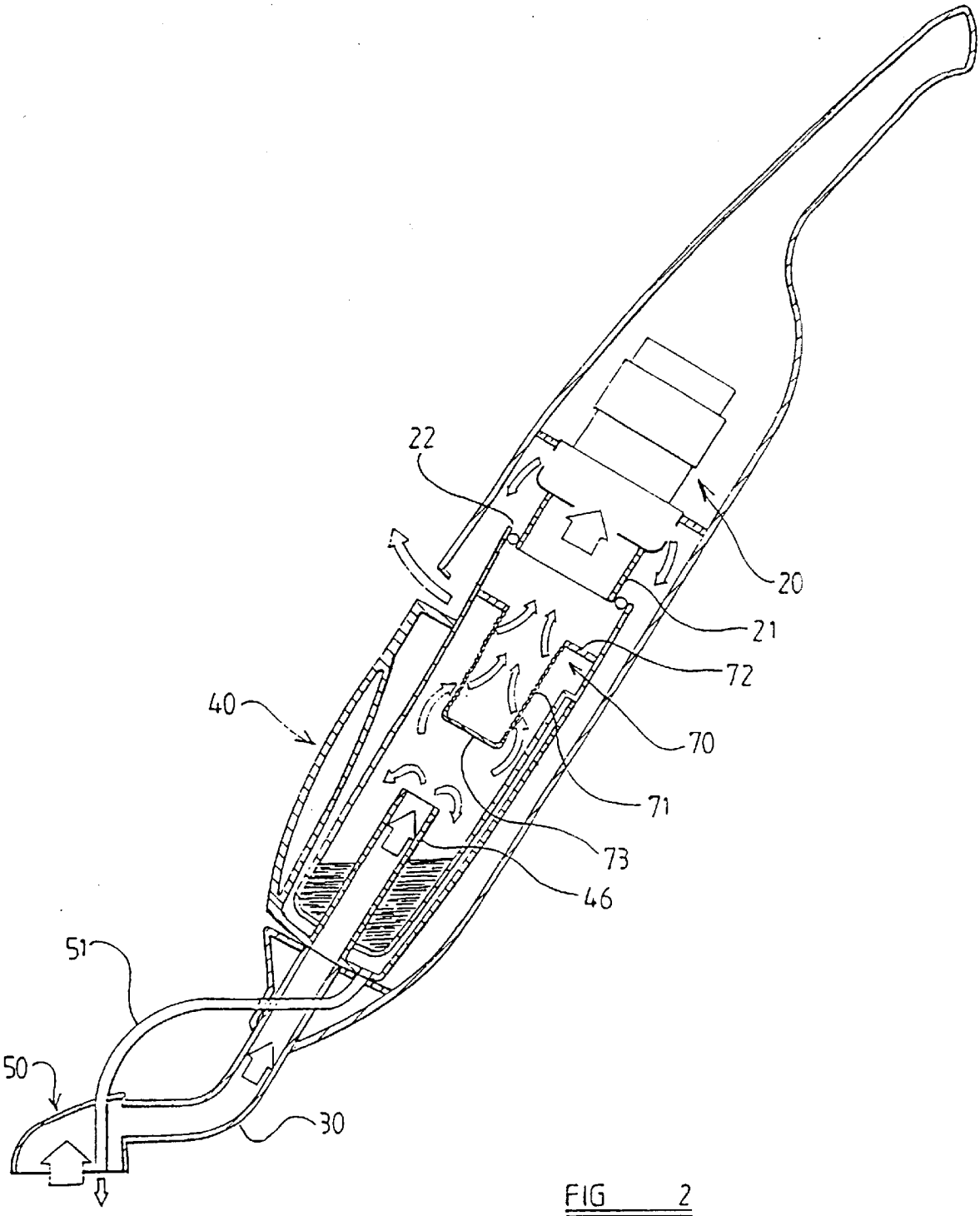
FIG. 2 shows such cleaner set up in the dry mode.

A suction cleaner embodying the present invention, as illustrated in FIGS. 1 and 2 by way of example, includes a body 10 which defines a housing for various operative components, including a motor/impeller unit 20 which provides a source of suction to draw air through a suction duct 30 and into a removable collection container 40 which is housed in a recess provided within the body 10.

The body 10 is formed to afford a handle assembly 11 at its upper end and, at its lower end, carries a suction head 50 of any convenient form. It will be understood that such head may, as in the illustrated embodiment, have provision for applying a cleaning liquid as hereinafter described, and that the head 50 may be mounted for swivelling movement relative to the suction duct 30 about a generally horizontal axis extending either in the fore-and-after direction or in a transverse direction.

In the illustrated embodiment, the collection container 40 comprises an outer body 41 of generally jug-like form having an integral handle 42 on the wall thereof which in use is outside relative to the recess in the body within which the container 40 is received.

In the illustrated embodiment, the outer body 41 of the container 40 serves as a reservoir compartment for clean water (normally containing a detergent or the like) which can be delivered to the suction head 50 by means of a liquid delivery pipe 51 which is releasably connected to the lower end of the outer body 41, desirably with the interposition of valve means (not shown) whereby the flow of liquid to the cleaning head can be regulated. However, it would be possible for the outer body 41 to be omitted where cleaning by the application of liquid is not required, the appliance then serving only to pick up liquid in the wet mode and dry matter in the dry mode.

The container 40 further comprises an inner compartment 45 which extends upwardly beyond the upper end of the outer body 41 and at its upper end is adapted to engage sealingly with an intake duct 21 of the motor/impeller unit 20, for example by means of an interposed sealing ring 22.

The inner compartment 45 is adapted to collect dry or wet material picked up by the suction head 50 and conveyed along suction duct 30.

For this purpose, the inner compartment 45 of the container 40 includes a suction passage comprising a central suction tube 46 which extends upwardly from the base 43 of the outer body 41 and through the base of the inner compartment 45 to a position approximately one third of the way up the height of the inner compartment 45. At its lower end, the tube 46 is releasably connectable to the suction duct 30 in any convenient manner.

The inner compartment 45 of the collection container 40 is adapted to receive, interchangeably, one of two separator units 60,70 in order to place the apparatus in a wet pick-up mode and a dry pick-up mode as respectively illustrated in FIGS. 1 and 2.

The wet-mode separator unit 60 comprises a tube 61 which is releasably connectable at the upper end of the suction tube 46 so as to form an extension thereof. At its outer end 62 the tube 61 carries a cap 63 which includes an end wall 64 of greater diameter than the tube 61, in register with, and spaced from, the outlet end 62 of the tube to serve as a baffle, and a circumferential skirt 65 which overlaps with an end portion of the tube 61 in spaced relation therefrom, whilst also being spaced from the side wall of the inner compartment 45 as shown in FIG. 1. Thus, in use air with liquid droplets entrained is drawn from the suction head 50, through the suction duct 30, tubes 46 and 61, and undergoes a sharp reversal of flow within the cap 63, in a manner which efficiently separates liquid droplets before the air flow is again reversed and drawn into the intake duct 21 of the motor/impeller assembly 20. Liquid separated from the air flow can then drain downwardly into the base of the inner compartment 45.

Preferably, the inner compartment 45 also includes an obliquely disposed annular baffle plate 66 which assists in retaining collected liquid in the base of the inner compartment as the apparatus is moved back and forth.

In the illustrated embodiment, the baffle plate 66 is provided at an oblique end face of an upwardly extending tubular wall 67 which terminates at its upper end in an outwardly directed flange 68 which engages the inner faces of the side walls of the inner compartment, an outlet aperture 69 being formed at the lowest point of the baffle plate 66 at its junction with the wall 67 to allow liquid to be discharged into the base portion of the inner compartment. The baffle plate is arranged so that the aperture 69 is positioned against the side of the inner compartment which is uppermost when the appliance is in use. The baffle 66 prevents spillage of collected liquid into the part of the compartment above the baffle plate if the appliance is laid down and minimises sloshing of the collected liquid due to back and forth movement of the appliance in use. An upwardly extending outlet tube (not shown) may be provided at the uppermost point of the baffle plate 66, diametrally opposed to the aperture 69, to enable the contents of the inner compartment 45 to be emptied without removing the baffle plate assembly, such outlet tube normally being closed at the upper end by means of a suitable removable stopper.

The assembly of baffle plates 66, tubular wall 67 and flange 68 may be removably located within the inner compartment 45 so as to facilitate emptying and cleaning of the latter after use.

The baffle plate 66 may be secured to, and carried by, the tube 61 of the separator unit 60 so as to form an effectively permanent part thereof, in which case it may be disposed nearer to the cap 63 than illustrated so as to increase the available volume of the inner compartment 45 beneath the baffle plate 66. In other embodiments, the baffle plate 66 may be releasably assembled with the tube 61, or with the suction tube 46 of the collection container.

In an alternative arrangement, the tubular wall 67 and flange 68 may be omitted so that the baffle plate 66 then engages around its periphery directly with the internal face of the inner compartment 45, except where the aperture 69 is required.

For operation in the dry mode, the wet-mode separator unit 60 is removed from the inner compartment 45 of the collection container 40 and the dry-mode separator unit 70 is inserted at the upper end of the inner compartment 45 as shown in FIG. 2. The dry-mode separator unit 70 comprises essentially any suitable filter element. In the illustrated embodiment a tubular filter element 71 carried by a mounting ring 72, the lowermost end of the filter element being closed by a baffle plate 73, on which air emerging from the tube 61 impinges so as to cause flow-reversal and to assist the separation of coarser particles before the air stream passes through the filter material which removes finer particles. However, it will be appreciated that other forms of filter may be employed if desired. Separated dust and other matter falls to the bottom of the inner compartment as shown, and the container 40 as a whole can be removed laterally from the recess in the housing for emptying.

When the dry-mode separator unit 70 is in use, the suction head 50 may be exchanged in known manner for a suction head of known type adapted for the pick-up of dry matter. Alternatively the suction head 50 may be converted for use as a dry matter pick-up head by means, for example, of an adapter in the form of a cover plate as described and claimed in our British Patent Application No. 9603250.3

What is claimed is:

1. A vacuum cleaner of the kind comprising a body which carries a main cleaning implement and a source of suction, the body having a recess adapted to receive a collection container releasably through an opening formed at one side of the body, wherein said collection container includes a suction passage which is releasably connectable at the base of the container to a suction duct connected with said cleaning implement, connection means are provided at the upper end of the collection container for releasable connection of said collection container to said source of suction within the body to establish suction at said cleaning implement and air flow from said implement through said duct and said suction passage to said source of suction, and two interchangeable separator units are provided for selective assembly with the collection container, one of said separator units being a wet-mode separator unit which is adapted for connection to said suction passage when the apparatus is to be operated in a wet mode and operates to separate entrained liquid droplets from the air-flow, and the other of said separator units being a dry-mode separator unit which is adapted to be mounted within the collection container at a position spaced from said suction passage when the apparatus is to be used in the dry mode and operates to separate dry material entrained in the air-flow.

2. A vacuum cleaner according to claim 1, wherein the wet-mode separator unit comprises a tube, forming in use an extension of said suction passage in the collection container, and having an outlet opening facing a cap which serves to reverse air flow from said outlet opening and function as an air/liquid separator within the collection container.

3. A vacuum cleaner according to claim 2 wherein said suction passage comprises a tube disposed centrally within said collection container, the wet-mode separator unit tube, when in use being connected to said suction passage tube and also disposed centrally of said collection container.

4. A vacuum cleaner according to claim 3 wherein said wet-mode separator unit tube is of substantially circular shape in transverse cross-section and said baffle is of substantially circular shape and of larger diameter than said tube.

5. A vacuum cleaner according to claim 4 wherein said baffle is formed with a generally cylindrical skirt which extends over, and in spaced relation to, an end portion of said tube, said skirt being spaced inwardly from the side wall of the collection container.

6. A vacuum cleaner according to claim 2 wherein the wet mode separator unit also includes an annular baffle-plate which is arranged to extend across the collection container and is obliquely inclined relative to said separator unit tube.

7. A vacuum cleaner according to claim 6 wherein a tubular wall is removably located within said collection container, and said annular baffle plate is carried by an oblique face of said tubular wall at an end thereof furthest from said outlet opening.

8. A vacuum cleaner according to claim 7 wherein said tubular wall is spaced inwardly from the side wall of said collection container and carries at an end thereof nearest said outlet opening a radially outwardly directed flange which engages in sealing relation with the side wall of said collection container.

9. A vacuum cleaner according to claim 8 wherein an outlet aperture is provided at the junction between said annular baffle plate and said tubular wall at a part of said oblique end face furthest from said outlet opening.

10. A vacuum cleaner according to claim 7 wherein an outlet aperture is provided at the junction between said annular baffle plate and said tubular wall at a part of said oblique end face furthest from said outlet opening.

11. A vacuum cleaner according to claim 1 wherein the dry-mode separator unit comprises a filter element adapted to be disposed within the collection container between the outlet of said suction passage and said connection means at the upper end of the collection container.

12. A vacuum cleaner according to claim 11 wherein said filter element is carried by a mounting ring which is removably mounted within, and sealingly engages against, the side wall of said collection container.

13. A vacuum cleaner according to claim 12 wherein said filter element is of tubular form and has an end remote from said mounting ring, and said end is closed by a baffle plate which, in use, is in register with and spaced from the outlet of said suction passage in said collection container.

14. A vacuum cleaner according to claim 1 wherein said collection container further comprises a reservoir compartment for clean water, and means are provided for delivery of said water to the cleaning head.

15. A vacuum cleaner according to claim 14, wherein said collection container comprises an inner compartment in which said interchangeable separator units are locatable, and said reservoir comprises an outer compartment, of a jug-like unit which is releasably assemblable with the body of the vacuum cleaner.

* * * * *

UNITED STATES PATENT AND TRADEMARK OFFICE

CERTIFICATE OF CORRECTION

PATENT NO. : 6,243,912 B1
DATED : June 12, 2001
INVENTOR(S) : Nicholas G. Grey

It is certified that error appears in the above-identified patent and that said Letters Patent is hereby corrected as shown below:

Title page,
Column 1, please insert -- [30] Priority Data: Great Britain No. 9603745.2 filed February 22, 1996 --.

Signed and Sealed this

Nineteenth Day of March, 2002

*Attest:*

*Attesting Officer*

JAMES E. ROGAN
*Director of the United States Patent and Trademark Office*